US008146461B1

(12) United States Patent
Su

(10) Patent No.: US 8,146,461 B1
(45) Date of Patent: Apr. 3, 2012

(54) TOOL EXTENSION ROD

(76) Inventor: Cheng-Wei Su, Taichung (TW)

( * ) Notice: Subject to any disclaimer, the term of this patent is extended or adjusted under 35 U.S.C. 154(b) by 0 days.

(21) Appl. No.: 13/098,423

(22) Filed: Apr. 30, 2011

(51) Int. Cl.
*B25B 23/16* (2006.01)

(52) U.S. Cl. ..... 81/177.85; 81/177.1; 81/177.2; 403/322.1; 403/322.2

(58) Field of Classification Search ..... 81/177.85, 81/177.1, 177.2, 489; 403/321–322.2, 325
See application file for complete search history.

(56) References Cited

U.S. PATENT DOCUMENTS

| | | | | |
|---|---|---|---|---|
| 4,502,365 | A * | 3/1985 | Hacker | 81/124.6 |
| 5,813,296 | A * | 9/1998 | Hoff et al. | 81/177.85 |
| 6,523,441 | B2 * | 2/2003 | Lee | 81/177.85 |
| 2004/0126182 | A1 * | 7/2004 | Lin | 403/322.2 |
| 2005/0109170 | A1 * | 5/2005 | Chang | 81/177.2 |
| 2007/0163406 | A1 * | 7/2007 | Liu | 81/177.85 |
| 2008/0047403 | A1 * | 2/2008 | Lin | 81/177.85 |

* cited by examiner

*Primary Examiner* — Monica Carter
*Assistant Examiner* — Melanie Alexander

(57) ABSTRACT

A tool extension rod which is adapted to be connected to or disconnected from a socket essentially comprises a rod body, a positioning unit, and a pushing sleeve. If the socket is connected to the rod body and fixed by the positioning unit, the pushing sleeve can be pushed to control the positioning unit so as to loosen and remove the socket from the rod body without any additional manual operation.

4 Claims, 5 Drawing Sheets

TOOL EXTENSION ROD

BACKGROUND OF THE INVENTION

1. Field of the Invention

The present invention relates to a tool extension rod, and more particularly to a tool extension rod which is adapted to be connected to or disconnected from a socket.

2. Description of the Prior Art

To save cost and reduce weight, different sized and types of hand tools and electric tools are made into small and light tool heads connected to a tool extension rod through a socket. To combine the socket and the tool extension rod more stably, the tool extension rod is provided with an engaging mechanism for fixing the socket. To replace the socket, the engaging mechanism is operated to loosen the socket, and then the socket in a half engaged state will be taken down by manual operation and replaced with a desired one. Therefore, the replacement of the socket requires additional manual operation, leading to inconvenience in use.

SUMMARY OF THE INVENTION

The primary objective of the present invention is to provide a tool extension rod which is adapted to be connected to or disconnected from a socket, with such a tool extension rod, the socket can be loosened and pushed away from the tool extension rod by a push without any additional manual operation.

Hence, to achieve the above objective, a tool extension rod which is adapted to be connected to or disconnected from a socket in accordance with the present invention comprises a rod body, a positioning unit, and a pushing sleeve. The rod body includes an end having a connecting portion to be engaged with the engaging portion of the socket. The positioning unit is disposed on the rod body and includes a protrusion and an engaging portion. The protrusion is allowed to move in the radial direction of the rod body, and the engaging portion is interactively connected to the protrusion so as to be engaged or disengaged from the socket. The pushing sleeve includes a first end surface and a second end surface in two opposite directions. The pushing sleeve is further formed with a resisting portion between the first and the second end surface. The pushing sleeve is mounted on the rod body and allowed to move to and fro in the axial direction of the rod body. The first end surface is located closer to the end of the rod body than the second end surface. When the pushing sleeve is moved toward the connecting portion of the rod body, the resisting portion will push against the protrusion of the protruding element to make the engaging portion of the engaging element move through the moving element.

Thereby, when the socket is mounted on the rod body and positioned thereon by the engaging portion of the engaging element, an end surface of the engaging portion of the socket is located in the pathway of the pushing sleeve. In such a case, when the pushing sleeve is pushed toward the connecting portion of the rod body, the resisting portion will push against the protrusion to make the engaging portion disengage from the socket, and the first end surface of the pushing sleeve will push against the end surface of the socket to make the socket disengage from the connecting portion of the rod body.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
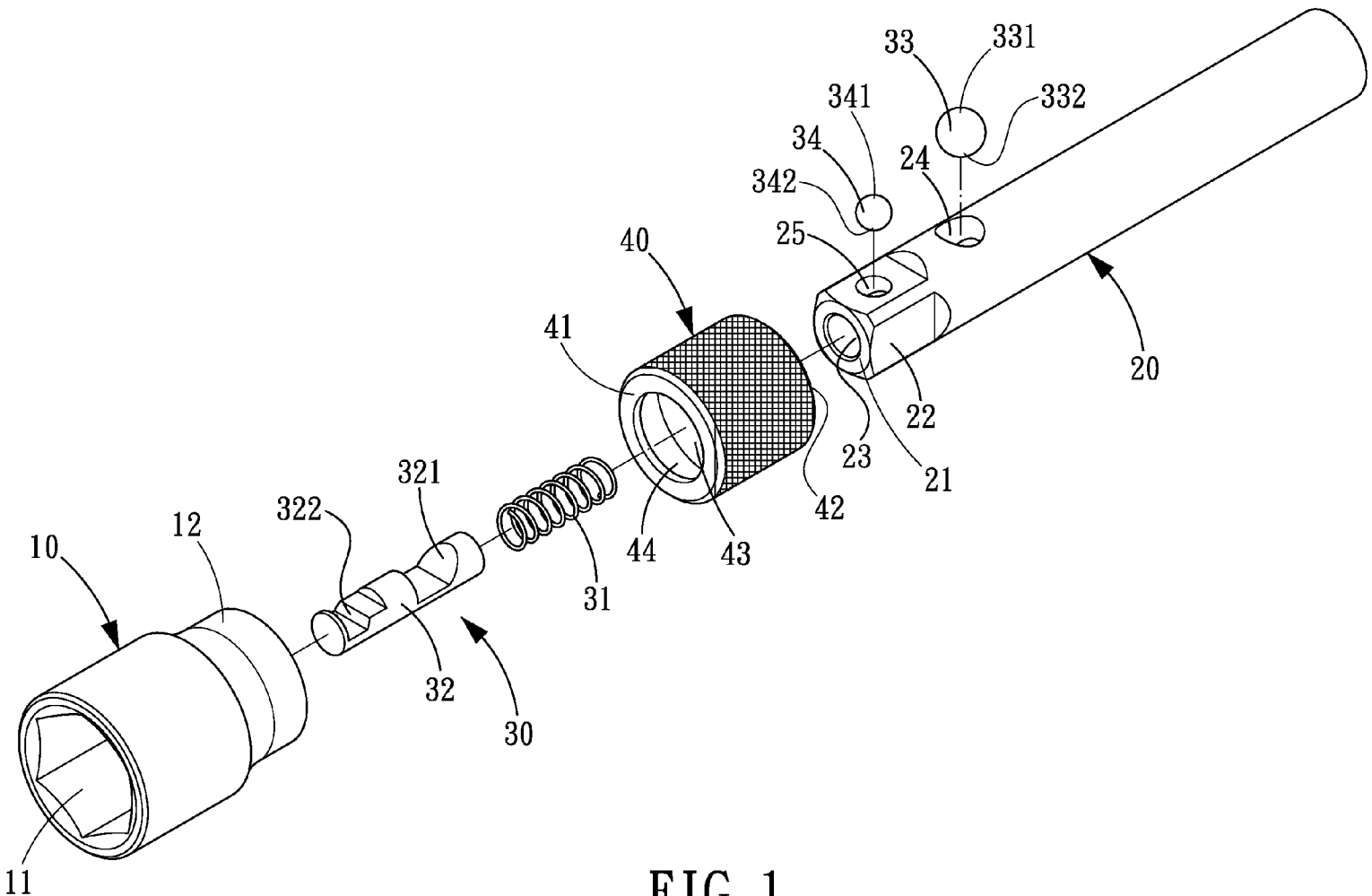
FIG. 1 is an exploded view of a tool extension rod in accordance with the present invention.
Figure 2:
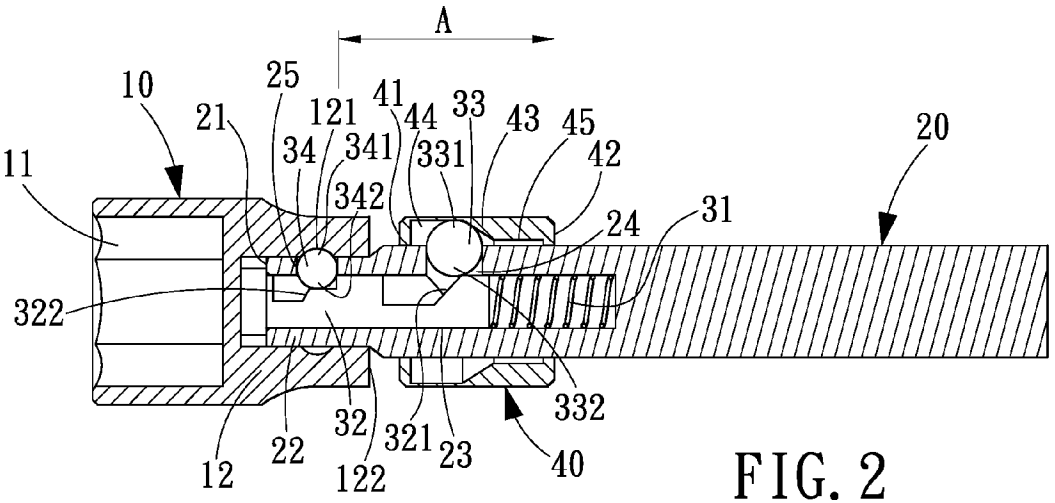
FIG. 2 is a cross-sectional view of the tool extension rod in accordance with the present invention.

Referring to FIGS. 1-2, a tool extension rod in accordance with a first embodiment of the present invention is adapted to be connected to and disconnected from a socket. The socket 10 includes a working portion 11 and an engaging portion 12 in two opposite directions thereof. The engaging portion 12 includes an engaging groove 121. The tool extension rod in accordance with the present invention essentially includes a rod body 20, a positioning unit 30 and a pushing sleeve 40.

The rod body 20 includes an end 21 having a connecting portion 22 to be engaged in the engaging portion 12 of the socket 10. The end 21 is formed with an accommodation groove 23 in an axial direction of the rod body 20. The rod body 20 includes a through hole 24 in communication with the accommodation groove 23. The connecting portion 22 includes an insertion hole 25 in communication with the accommodation groove 23.

Figure 3:
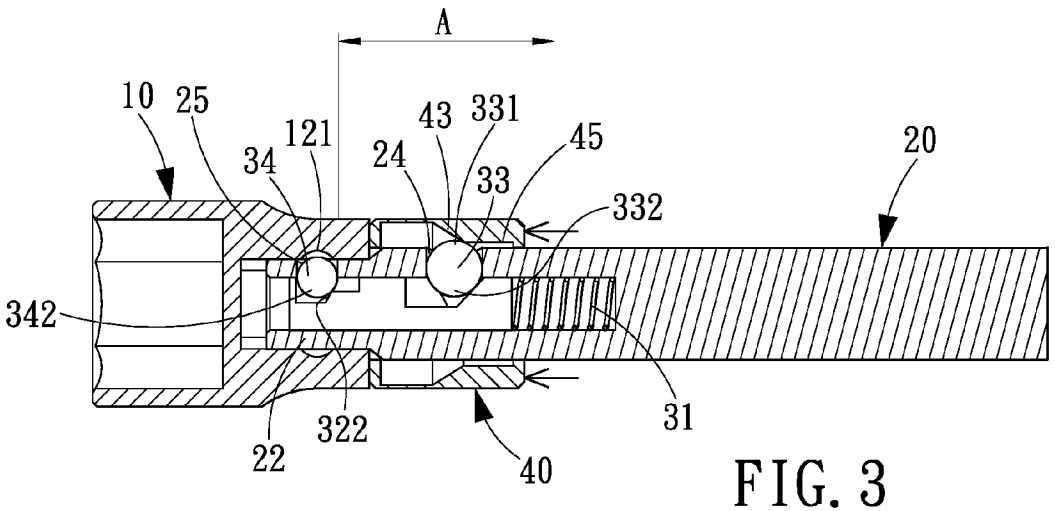
FIG. 3 is a first cross-sectional view showing that the socket is pushed away from the tool extension rod in accordance with the present invention.

The positioning unit 30 includes a spring 31, a moving element 32, a protruding element 33 and an engaging element 34. The spring 31 is disposed in the accommodation groove 23 in a compressed manner and has both ends pushed against a bottom surface of the accommodation groove 23 and the moving element 32. The moving element 32 is disposed in the accommodation groove 23 and pushed toward an opening of the accommodation groove 23 by the spring 31. The moving element 32 includes a first oblique surface 321 in alignment with or staggered with respect to the through hole 24 of the rod body 20, and a second oblique surface 322 in alignment with or staggered with respect to the insertion hole 25 of the rod body 20. The protruding element 33 is movably disposed between the through hole 24 and the accommodation groove 23 and relatively movable in a radial direction of the rod body 20. The protruding element 33 includes a protrusion 331 and a first end 332 in two opposite directions. The first end 332 is pushed against by the first oblique surface 321. The protrusion 331 is disposed in the through hole 24 and allowed to extend out or retract into the through hole 24. The engaging element 34 is movably disposed between the insertion hole 25 and the accommodation groove 23 and relatively movable in the radial direction of the rod body 20. The engaging element 34 includes an engaging portion 341 and a second end 342 in two opposite directions. The second end 342 is pushed against by the second oblique surface 322. The engaging portion 341 is disposed in the insertion hole 25 and allowed to extend out or retract into the insertion hole 25. The engaging element 34 and the protruding element 33 are interactively linked by the moving element 32, such that the engaging portion 341 can engage into and disengage from the engaging groove 121 of the socket 10. It is to be noted that, as shown in FIG. 2, the first oblique surface 321 is in alignment with the through hole 24, and the second oblique surface 322 is staggered with respect to the insertion hole 25, and as shown in FIG. 3, when the moving element 32 is pushed by the protruding element 33 to move toward the spring 31, the first oblique surface 321 will be staggered with respect to the through hole 24, and the second oblique surface 322 will be in alignment with the insertion hole 25.

The pushing sleeve 40 which is circular in cross section is mounted on the rod body 20 and allowed to move to and fro in the axial direction of the rod body 20. The pushing sleeve 40 includes a first end surface 41 and a second end surface 42 in two opposite directions, and the first end surface 41 is located closer to the end 21 of the rod body 20 than the second end surface 42. The pushing sleeve 40 is further formed with a resisting portion 43 between the first and the second end surfaces 41, 42, an evasion space 44 between the first end surface 41 and the resisting portion 43 for accommodation of the protrusion 331 of the protruding element 33, and a pressing portion 45 between the resisting portion 43 and the second end surface 42 for pressing against the protrusion 331 of the protruding element 33. The pressing portion 45 is located closer to an outer surface of the rod body 20 than the evasion space 44. Additionally, the resisting portion 43 is tapered from the evasion space 44 toward the pressing portion 45. When the pushing sleeve 40 is moved toward the connecting portion 22 of the rod body 20, the resisting portion 43 will push against the protrusion 331 of the protruding element 33 to make the engaging portion 341 of the engaging element 34 move through the moving element 32.

Thereby, when the socket 10 is mounted on the rod body 20 and positioned thereon by the engaging portion 341 of the engaging element 34, an end surface 122 of the engaging portion 12 of the socket 10 is located in the pathway A of the pushing sleeve 40. In such a case, when the pushing sleeve 40 is pushed toward the connecting portion 22 of the rod body 20, the resisting portion 43 will push against the protrusion 331 to make the engaging portion 341 disengage from the socket 10, and the first end surface 41 of the pushing sleeve 40 will push against the end surface 122 of the socket 10 to make the socket 10 disengage from the connecting portion 22 of the rod body 20.

The aforementioned is the summary of the positional and structural relationship of the respective components of the first embodiment in accordance with the present invention.

Figure 4:
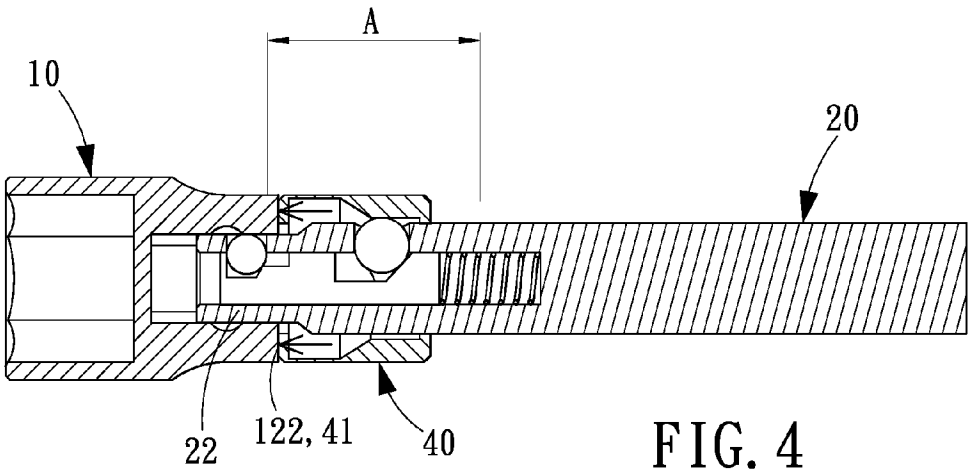
FIG. 4 is a second cross-sectional view showing that the socket is pushed away from the tool extension rod in accordance with the present invention.

The operation of the tool extension rod in accordance with the first embodiment of the present invention should be made to FIGS. 2-5:

As shown in FIG. 2, when the engaging portion 12 of the socket 10 is positioned on the connecting portion 22 of the rod body 20 by the engaging portion 341 of the engaging element 34 engaged in engaging groove 121, to remove and replace the engaging socket 10 with a different style or size of socket, as shown in FIGS. 3 and 4, the user will push the pushing sleeve 40 toward the connecting portion 22 of the rod body 20, at this moment, the resisting portion 43 of the pushing sleeve 40 presses against the protrusion 331 of the protruding element 33 so as to make the protruding element 33 move downwards in the radial direction of the rod body 20. After that, the pressing portion 45 of the pushing portion 40 is used to keep the protruding element 33 retracting into the through hole 24, synchronously allowing the protrusion 331 of the protruding element 33 to sink in the through hole 24. When moving downwards, the protruding element 33 will push the first oblique surface 321 of the moving element 32 through the first end 332, so that the moving element 32 will move toward the spring 31. When the moving element 32 moves toward the spring 31, the engaging element 34 will move downwards in the radial direction of the rod body 20 along the second oblique surface 322, and the engaging portion 341 of the engaging element 34 will sink in the insertion hole 25 and completely disengage from the engaging groove 121 of the socket 10. At this moment, the socket 10 is only placed on but not fixed to the rod body 20.

Figure 5:
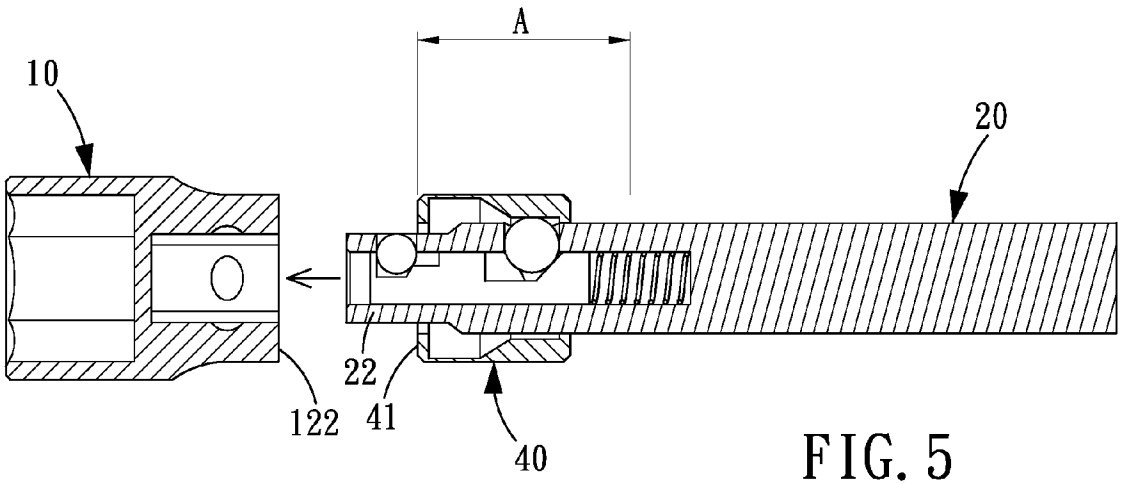
FIG. 5 is a cross-sectional view showing that the socket is completely pushed away from the tool extension rod in accordance with the present invention.

Subsequently, as shown in FIGS. 4 and 5, when the pushing sleeve 40 is continuously pushed toward the connecting portion 22 of the rod body 20, since the end surface 122 of the socket is located in the pathway A of the pushing sleeve 40, the first end surface 41 of the pushing sleeve 40 will finally push against the end surface 122 of the socket 10, so that the socket 40 can completely move away from the connecting portion 22 of the rod body 20.

Hence, with the present invention, the socket 10 can be loosened and pushed away from the rod body 20 by a push without any additional manual operation.

Figure 6:
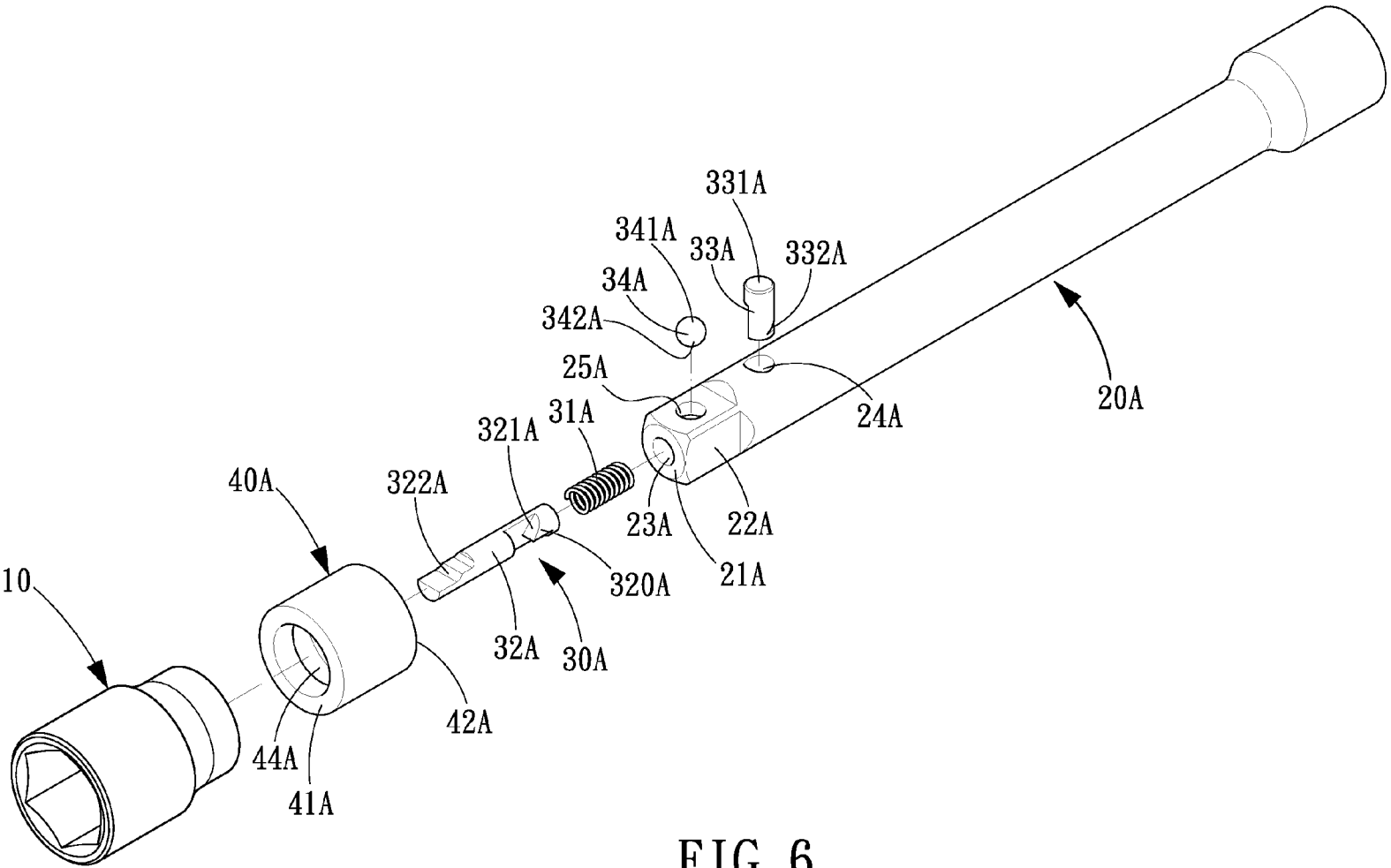
FIG. 6 is an exploded view of another tool extension rod in accordance with the present invention.
Figure 7:
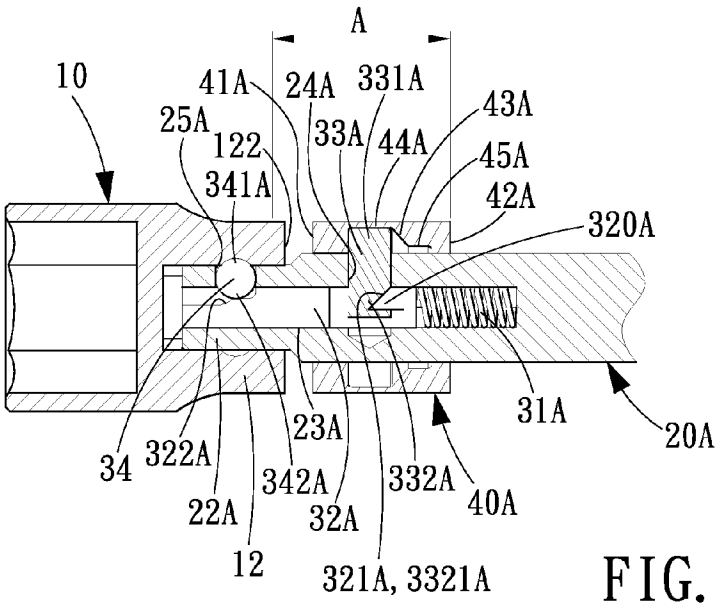
FIG. 7 is a partial cross-sectional view of the tool extension rod of FIG. 6.
Figure 8:
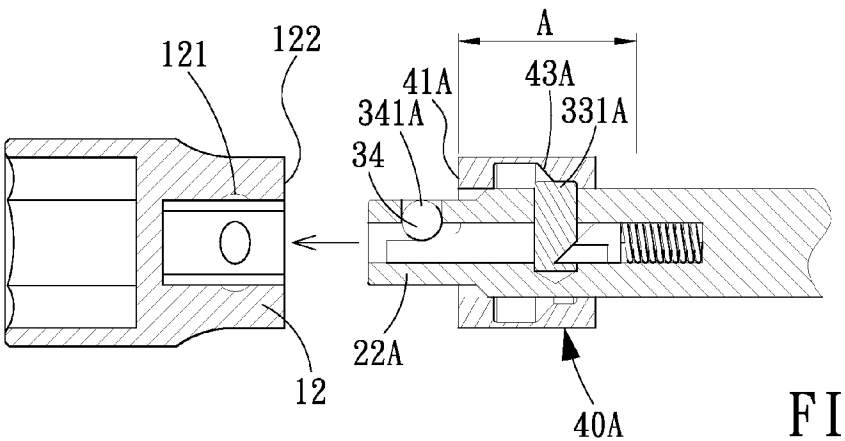
FIG. 8 is a cross-sectional view showing that the socket is completely pushed away from the tool extension rod of FIG. 7.

Referring to FIGS. 6-8, a tool extension rod in accordance with a second embodiment of the present invention comprises a rod body 20A, a positioning unit 30A and a pushing sleeve 40A. The positional and structural relationship of the respective components of the second embodiment is the same as the first embodiment.

The rod body 20A includes an end 21A, a connecting portion 22A, an accommodation groove 23A, a through hole 24A and an insertion hole 25A.

The positioning unit 30A includes a spring 31A, a moving element 32A, a protruding element 33A and an engaging element 34A. The moving element 32A includes a first oblique surface 321A, a second oblique surface 322A, and a hook portion 320A. The first oblique surface 321A is arranged on the hook portion 320A. The protruding element 33A includes a protrusion 331A, and a first end 332A. The protruding elements 33, 33A are different in that the first end 332A is hooked on the hook portion 320A and includes an oblique surface 3321A pushed by the first oblique surface 321A. The engaging element 34A includes an engaging portion 341A and a second end 342A.

The pushing sleeve 40A includes a first end surface 41A, a second end surface 42A, a resisting portion 43A, an evasion space 44A, and a pressing portion 45A.

Thereby, when the socket 10 is mounted on the rod body 20A and positioned thereon by the engaging portion 341A of the engaging element 34A, the end surface 122 of the engaging portion 12 of the socket 10 is located in the pathway A of the pushing sleeve 40A. In such a case, when the pushing sleeve 40A is pushed toward the connecting portion 22A of the rod body 20A, the resisting portion 43A will push against the protrusion 331A to make the engaging portion 341 A disengage from the socket 10, and the first end surface 41A of the pushing sleeve 40A will push against the end surface 122 of the socket 10 to make the socket 10 disengage from the connecting portion 22A of the rod body 20A. Since the operation of the second embodiment is almost the same as the first embodiment, no further explanation is provided herein. The first embodiment and the second embodiment are in operation different in that: the moving element 32A is hooked to the protruding element 33A through its hook portion 320A, and the first oblique surface 321A of the hook portion 320A cooperates with the oblique surface 3321A of the first end 332A to move the moving element 32A and the hook portion 320A.

While we have shown and described various embodiments in accordance with the present invention, it is clear to those skilled in the art that further embodiments may be made without departing from the scope of the present invention.

What is claimed is:

1. A tool extension rod being adapted to be connected to or disconnected from a socket, the socket including a working portion and an engaging portion in two opposite directions, the engaging portion including an engaging groove, the tool extension rod comprising:

a rod body including an end having a connecting portion to be engaged in the engaging portion of the socket, the end of the rod body being formed with an accommodation groove in an axial direction of the rod body, the rod body including a through hole in communication with the accommodation groove, the connecting portion of the rod body including an insertion hole in communication with the accommodation groove;

a positioning unit including a spring disposed in the accommodation groove, a moving element disposed in the accommodation groove and pressing against the spring, a protruding element, and an engaging element, the moving element including a first oblique surface in alignment with or staggered with respect to the through hole of the rod body, and a second oblique surface in alignment with or staggered with respect to the insertion hole of the rod body, the protruding element being movably disposed between the through hole and the accommodation groove and relatively movable in a radial direction of the rod body, the protruding element including a protrusion and a first end in two opposite directions, the first end of the protruding element being pushed against by the first oblique surface of the moving element, the engaging element being movably disposed between the insertion hole and the accommodation groove and relatively movable in the radial direction of the rod body, the engaging element including an engaging portion and a second end in two opposite directions, the second end of the engaging element being pushed against by the second oblique surface of the moving element, the engaging element and the protruding element being interactively linked by the moving element, such that the engaging portion being allowed to engage into and disengage from the engaging groove of the socket; and a pushing sleeve being mounted on the rod body and allowed to move to and fro in the axial direction of the rod body, the pushing sleeve including a first end surface and a second end surface in two opposite directions, the first end surface being located closer to the end of the rod body than the second end surface, the pushing sleeve being further formed with a resisting portion between the first and the second end surfaces, an evasion space between the first end surface and the resisting portion for accommodation of the protrusion of the protruding element, and a pressing portion between the resisting portion and the second end surface for pressing the protrusion of the protruding element, the pressing portion being located closer to an outer surface of the rod body than the evasion space, when the pushing sleeve is moved toward the connecting portion of the rod body, the resisting portion will push against the protrusion of the protruding element to make the engaging portion of the engaging element move through the moving element;

thereby, when the socket is mounted on the rod body and positioned thereon by the engaging portion of the engaging element, an end surface of the engaging portion of the socket is located in a pathway of the pushing sleeve, in such a case, when the pushing sleeve is pushed toward the connecting portion of the rod body, the resisting portion will push against the protrusion to make the engaging portion disengage from the engaging groove of the socket, and the first end surface of the pushing sleeve will push against the end surface of the socket to make the socket disengage from the connecting portion of the rod body.

2. The tool extension rod as claimed in claim 1, wherein the resisting portion is tapered from the evasion space toward the pressing portion.

3. A tool extension rod being adapted to be connected to or disconnected from a socket, the socket including a working portion and an engaging portion in two opposite directions, the engaging portion including an engaging groove, the tool extension rod comprising:

a rod body including an end having a connecting portion to be engaged in the engaging portion of the socket, the end of the rod body being formed with an accommodation groove in an axial direction of the rod body, the rod body including a through hole in communication with the accommodation groove, the connecting portion of the rod body including an insertion hole in communication with the accommodation groove;

a positioning unit including a spring disposed in the accommodation groove, a moving element disposed in the accommodation groove and pressing against the spring, a protruding element, and an engaging element, the moving element including a hook portion, and a second oblique surface in alignment or staggered with respect to the insertion hole of the rod body, the hook portion including a first oblique surface in alignment with or staggered with respect to the trough hole of the rod body, the protruding element being movably disposed between the through hole and the accommodation groove and relatively movable in a radial direction of the rod body, the protruding element including a protrusion and a first end in two opposite directions, the first end being hooked on the hook portion and including an oblique surface pushed against by the first oblique surface of the moving element, the engaging element being movably disposed between the insertion hole and the accommodation groove and relatively movable in the radial direction of the rod body, the engaging element including an engaging portion and a second end in two opposite directions, the second end of the engaging element being pushed against by the second oblique surface of the moving element, the engaging element and the protruding element being interactively linked by the moving element, such that the engaging portion being allowed to engage into and disengage from the engaging groove of the socket; and a pushing sleeve being mounted on the rod body and allowed moved to and fro in the axial direction of the rod body, the pushing sleeve including a first end surface and a second end surface in two opposite directions, the first end surface being located closer to the end of the rod body than the second end surface, the pushing sleeve being further formed with a resisting portion between the first and the second end surfaces, an evasion space between the first end surface and the resisting portion for accommodation of the protrusion of the protruding element, and a pressing portion between the resisting portion and the second end surface for pressing the protrusion of the protruding element, the pressing portion being located closer to an outer surface of the rod body than the evasion space, when the pushing sleeve is moved toward the connecting portion of the rod body, the resisting portion will push against the protrusion of the protruding element to make the engaging portion of the engaging element move through the moving element;

thereby, when the socket is mounted on the rod body and positioned thereon by the engaging portion of the engaging element, an end surface of the engaging portion of the socket is located in a pathway of the pushing sleeve, in such a case, when the pushing sleeve is pushed toward the connecting portion of the rod body, the resisting portion will push against the protrusion to make the engaging portion disengage from the engaging groove of the socket, and the first end surface of the pushing sleeve will push against the end surface of the socket to make the socket disengage from the connecting portion of the rod body.

4. The tool extension rod as claimed in claim 3, wherein the resisting portion is tapered from the evasion space toward the pressing portion.

* * * * *